US006999690B2

(12) United States Patent
Watanabe et al.

(10) Patent No.: US 6,999,690 B2
(45) Date of Patent: Feb. 14, 2006

(54) IMAGE FORMING APPARATUS

(75) Inventors: Yasunari Watanabe, Shizuoka (JP); Motoki Adachi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/617,024

(22) Filed: Jul. 11, 2003

(65) Prior Publication Data

US 2004/0013438 A1 Jan. 22, 2004

(30) Foreign Application Priority Data

Jul. 18, 2002 (JP) ..... 2002-209509

(51) Int. Cl.
*G03G 15/02* (2006.01)

(52) U.S. Cl. ..... 399/50

(58) Field of Classification Search ..... 399/50, 399/174, 175, 176, 149, 150, 53, 55
See application file for complete search history.

(56) References Cited

U.S. PATENT DOCUMENTS

| | | | | |
|---|---|---|---|---|
| 6,128,456 | A * | 10/2000 | Chigono et al. | 399/176 |
| 6,415,127 | B1 | 7/2002 | Yamamoto, et al. | 399/284 |
| 6,532,347 | B1 | 3/2003 | Watanabe, et al. | 399/50 |
| 6,640,063 | B1 * | 10/2003 | Adachi et al. | 399/50 |
| 2002/0102108 | A1 | 8/2002 | Adachi, et al. | 399/50 |
| 2003/0049048 | A1 | 3/2003 | Yoshikawa, et al. | 399/129 |
| 2003/0077088 | A1 | 4/2003 | Adachi, et al. | 399/129 |

FOREIGN PATENT DOCUMENTS

| | | |
|---|---|---|
| JP | 3-52058 | 8/1991 |
| JP | 2000-305342 | * 11/2000 |
| JP | 2001-166565 | 6/2001 |
| JP | 2001-201920 | 7/2001 |

* cited by examiner

*Primary Examiner*—Hoang Ngo
(74) *Attorney, Agent, or Firm*—Fitzpatrick, Cella, Harper & Scinto

(57) ABSTRACT

Provided is an image forming apparatus including a unit for controlling each voltage value of peak-to-peak voltages of DC and AC voltages applied to a charging unit for charging an image bearing member, in which a residual charge eliminating unit conducts charge elimination on a surface of the image bearing member while at least the charging unit undergoes an application of the AC voltage including the peak-to-peak voltage that is, in the case of setting at Vth a discharge start voltage to the image bearing member when applying the DC voltage to the charging unit, twice or smaller than this discharge start voltage Vth. With this image forming apparatus, it is possible to restrain an occurrence of a defect in an image which is attributable to an instability of a charging potential on the image bearing member by stabilizing a potential on the image bearing member at zero even in a case where the AC voltage applied to the charging unit for the image bearing member is the peak-to-peak voltage that is twice or smaller than Vth.

18 Claims, 4 Drawing Sheets

IMAGE FORMING APPARATUS

BACKGROUND OF THE INVENTION

1. Field of the Invention

The present invention relates to an image forming apparatus such as an electrophotographic type copying machine or a printer/facsimile, etc.

2. Related Background Art

Conventionally, in an image forming apparatus such as an electrophotographic apparatus, an electrostatic recording apparatus, etc., what has hitherto been a general method of charging the surface of an image bearing member as a member to be charged such as a photosensitive member, a dielectric body, etc., is corona electrical charging that is a non-contact charging method of charging the surface of the image bearing member in a way that makes a corona generated by applying a high voltage to a thin corona discharge wire act on this image bearing member surface.

In recent years, in terms of a low voltage process, a low ozone generation quantity and a lost cost, a mainstream system is a contact charging system in terms of a low voltage process, a low ozone generation quantity and a low cost, in which a charging member such as a roller type charging member, a blade type charging member, etc. is brought into contact with the surface of the image bearing member, and the surface of the image bearing member is charged by applying a voltage to the charging member. In particular, the roller type charging member is capable of performing stable charging over a long period of time (Japanese Examined Patent Publication No. 3-52058).

Only a DC voltage may suffice as the voltage applied to the charging member, however, the charging can be uniformly effected by applying an oscillation voltage to cause discharges toward a plus side and a minus side alternately.

For example, there is a known method exhibiting an effect of uniformizing the charging of a member to be charged by applying an oscillating voltage. The oscillation voltage is obtained by superposing an AC voltage including a peak-to-peak voltage that is twice or larger than a discharge start threshold voltage (charge start voltage) of the member to be charged obtained upon application of a DC voltage thereto and a DC voltage (DC offset bias).

A waveform of the oscillating voltage is not limited to a sine wave and may also be a rectangular wave, a triangular wave and a pulse wave. The oscillating voltage includes a voltage of the rectangular wave formed by periodically switching ON/OFF the DC voltage, and also a voltage having the same output as that of a superposed voltage of the AC voltage and the DC voltage by periodically changing a value of the DC voltage.

As described above, a contact charging system for charging the charging member by applying the oscillating voltage thereto will hereinafter be referred to as an "AC charging system". Further, a contact charging system for charging by applying only the DC voltage will be referred to as a "DC charging system".

According to the AC charging system, however, as compared with the DC charging system, a discharge quantity to the image bearing member increases, and hence there might be a case where deterioration of the image bearing member such as a chip-off, etc. is accelerated, and there appears an abnormal image such as an image flow due to a discharging product in a high-temperature, high-humidity environment.

An improvement of this problem entails minimizing the discharging caused toward the plus side and the minus side alternately by applying the voltage at the minimum required.

In fact, however, a relationship between the voltage and the discharge quantity is not invariably fixed but changes depending on a layer thickness of each of a photosensitive member layer of the image bearing member and a dielectric member layer, the charging member, an environmental fluctuation of the air and so forth. In a low-temperature low-humidity environment (L/L), the material is dried with the result that a resistance value increases so that the discharge is unlikely to be caused. Therefore a peak-to-peak voltage having a fixed or greater value is needed for obtaining the uniform charging. In a lowest voltage value with which the uniformity of the charging is obtained in this L/L environment, however, in the case of conducting the charging operation in the high-temperature high-humidity environment (H/H), the material absorbs the humidity, and the resistance value decreases on the contrary, with the result that the charging member causes unnecessary discharging. As a consequence, if the discharge quantity increases, there arise such problems that the image flow and a defocused image are formed, a toner is fused, the chip-off and a shortening of lifetime of the image bearing member due to the deterioration of the surface of the image bearing member are caused, and so on.

In order to restrain the discharging increase and decrease in the discharge quantity due to this environmental fluctuation, an "AC constant current control system" that controls a current value of the flowing AC current by applying the AC voltage to the charging member is proposed in addition to the "AC constant voltage control system" that applies the fixed AC voltage at all times as described above. According to this AC constant current control system, in the L/L environment where the resistance of the material rises, the peak-to-peak voltage value of the AC voltage can be raised. On the contrary, in the H/H environment where the resistance of the material decreases, the peak-to peak voltage value of the AC voltage can be lowered. It is therefore possible to restrain the increase and decrease in the discharge quantity as compared with the AC constant voltage control system.

Herein, the charging member is not necessarily kept in contact with the surface of the image bearing member. The charging member and the image bearing member may be disposed in a non-contact manner in close proximity to each other with an air gap (gap) that is, for example, several tens of $\mu$m on condition that just a dischargeable area determined by a gap-to-gap voltage and a compensation Paschen's curve be certainly assured (proximal charging). This proximal charging shall come under a category of the contact charging.

Aiming at a longer lifetime of the image bearing member, however, the AC constant current control system is not yet perfect in terms of fluctuation in resistance value due to ununiformity in manufacturing the charging member and a contamination thereof, fluctuation in electrostatic capacitance of the image bearing member due to endurance thereof, and restraining the increase and decrease in the discharge quantity. Thus, in order to restrain the increase and decrease in the discharge quantity, means for restraining ununiformity in manufacturing the charging member and the environmental fluctuation as well as means for eliminating a deflection in high voltage must be taken. This brings about a rise in cost.

Such being the case, the following contrivances were made (Japanese Patent Application Laid-Open Nos. 2001-166565 and 2001-201920). Namely, a relationship between the voltage and the current is measured by applying the peak-to-peak voltages in a discharge area and an undischarged area to the charging member during a pre-rotation process, image formation, and a sheet space setting process, etc., of the image forming apparatus. Then, the peak-to-peak voltage to be applied to the charging member upon image formation is compensated from the measured value each time and is thus applied. Accordingly, it becomes possible to properly control the voltage and the current applied to the charging member to effect the uniform charging without causing any problems such as the deterioration of the image bearing member, the fusion of the toner, the image flow, etc. in a way that invariably causes a fixed quantity of discharge with no occurrence of an excessive discharge in spite of fluctuation in resistance value of the charging member which appears depending on the environment and the manufacturing process. Further, it becomes also possible to conduct uniform charging irrespective of a contamination of the charging member even during a consecutive image formation, thereby enabling a high image quality and a high definition to be stably maintained over a long period of time.

However, when a peak-to-peak voltage that is twice or smaller than a discharge start voltage Vth at which the charging means starts charging the photosensitive member is applied, in order to measure the current quantity in the undischarged area, a charging potential on the photosensitive member becomes unstable and does not come to a predictable potential state. Especially in the case of using the contact developing for the developing means, even if a power supply to the developing means is suspended, the developer is adhered to the image bearing member as the potential on the photosensitive member attracts. Moreover, in the case of using the two-component developing system, the magnetic carrier in the developer is adhered to the image bearing member as the potential on the photosensitive member attracts, resulting in a cause of a defect in the image.

SUMMARY OF THE INVENTION

It is an object of the present invention to provide an image forming apparatus capable of preventing a developer from being adhered to an image bearing member.

It is another object of the present invention to provide an image forming apparatus capable of stabilizing an unstable potential on the image bearing member.

It is still another object of the present invention to provide an image forming apparatus capable of restraining a defective image from being formed.

It is a further object of the present invention to provide an image forming apparatus capable of stabilizing a discharge by a charging means to the image bearing member.

It is a still further object of the present invention to provide an image forming apparatus capable of simplifying a voltage application sequence of the charging means and a developing means.

DETAILED DESCRIPTION OF THE PREFERRED EMBODIMENTS

Figure 1:
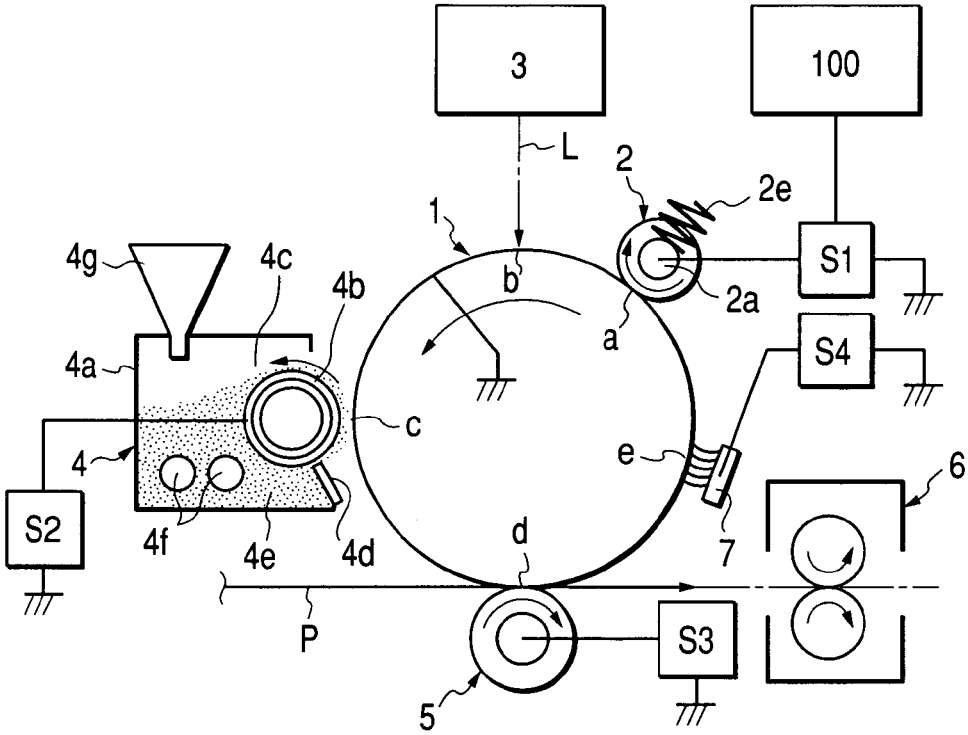
FIG. 1 is a schematic view showing an outline of configuration of an image forming apparatus in an embodiment.

FIG. 1 is a view showing by way of an example an outline of configuration of an image forming apparatus according to the present invention. The image forming apparatus in this embodiment is classified as a laser beam printer, of which a maximum paper passing size is an A3 size, utilizing a transfer type electrophotographic process and involving a contact charging system, a reversal developing system and a cleanerless system for performing cleaning simultaneously with developing in a developing device.

(1) Structural Outline of Whole Laser Beam Printer a) Image Bearing Member

Reference numeral 1 represents a rotary drum type electrophotographic photosensitive member (which will hereinafter be referred to as a photosensitive drum) as an image bearing member. This photosensitive drum 1 is an organic photoconductive (OPC) drum exhibiting a negative charging property. The photosensitive drum 1 is 50 mm in major diameter and is rotationally driven counterclockwise as indicated by an arrowhead about a central spindle at a process speed (circumferential speed) of 10 mm/sec.

Figure 2:
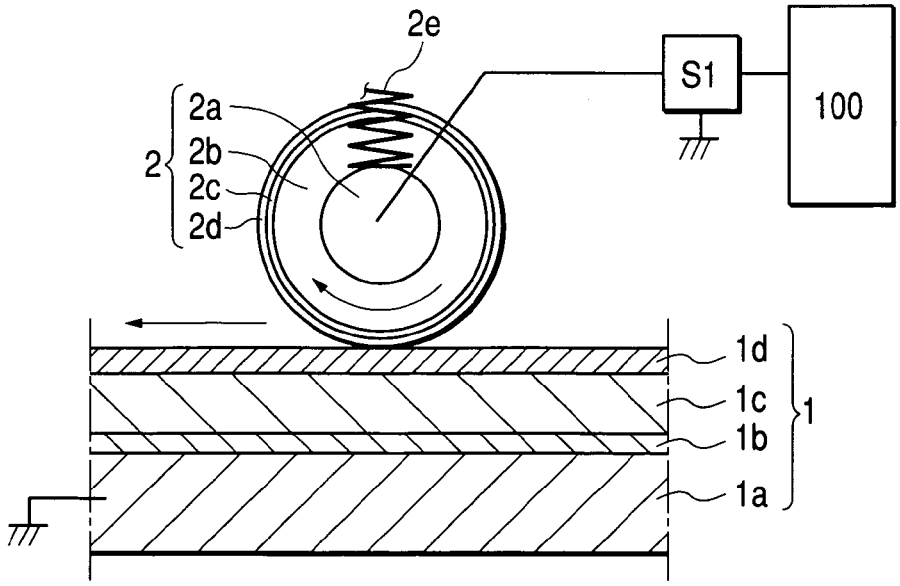
FIG. 2 is a view showing a photosensitive drum and a layer structure of a charging roller.

This photosensitive drum 1 has, as in a layer structure pattern view of FIG. 2, such a structure that three layers, i.e., a base layer 1*b* for restraining interference of the light and improving a bonding property to upper layers, an optical charge generation layer 1*c* and a charge transporting layer 1*d*, are coated in superposition sequentially from under over the surface of an aluminum cylinder (Conductive Drum Substrate) 1*a*.

b) Charging Means

Reference numeral 2 designates a charging means for uniformly charging an outer peripheral surface of the photosensitive drum 1 to a predetermined polarity and a predetermined potential. In this embodiment, the charging means 2 is a roller charger (which will hereinafter be referred to as a charging roller) serving as a contact charger (contact charging member). A voltage under a predetermined condition is applied to this charging roller 2, whereby the surface of the photosensitive drum 1 is uniformly charged to the negative polarity. The symbol "a" denotes a press-contact portion between the photosensitive drum 1 and the charging roller 2, and this press-contact portion is defined as a charging portion (charging nip portion).

A length to which the charging roller 2 charges in the longitudinal direction the surface of the photosensitive drum 1, is 320 mm, and this charging roller 2 has, as shown in the layer structure pattern view of FIG. 2, a three-layered structure in which a lower layer 2*b*, and intermediate layer 2*c* and a surface layer 2*d* are laminated sequentially from under round an outer periphery of a core metal bar (support member) 2*a*. The lower layer 2*b* is a foamed sponge layer for reducing a charging noise, the intermediate layer 2*c* is a conductive layer for obtaining an uniform resistance on the whole of charging roller, 2 in this embodiment are given as follows.

Core metal bar 2*a* is a stainless rod having a diameter of 6 mm, the lower layer 2*b* is foamed EPDM (ethylene-propylene-diene terpolymer) with carbon dispersed, of which specific gravity is 0.5 g/cm$^3$, volume resistance value is $10^3$ Ωcm, layer thickness is 3.0 mm, and length is 320 mm.

The intermediate layer 2*c* is a NBR (acrylonitrile-butadiene rubber)-series rubber with carbon dispersed, of which volume resistance value is $10^3$ Ωcm, and layer thickness is 700 μm.

Surface layer 2*d* is a fluorine compound tolidine resin with tin oxide and carbon dispersed, of which volume resistance value is $10^8$ Ωcm, surface roughness (JIS standard ten point average surface roughness Ra) is 1.5 μm, and layer thickness is 10 μm.

This charging roller 2 is constructed such that both side ends of the core metal bar 2*a* are rotatably held respectively by bearing members, the core metal bar 2*a* is biased toward the photosensitive drum 1 by a press spring 2*e* and thus brought into press-contact with the surface of the photosensitive drum 1 by a predetermined pressing force, whereby the charging roller 2 is rotated following up the rotations of the photosensitive drum 1.

Then, a predetermined oscillating voltage obtained by superposing an AC voltage having a frequency "f" on a DC voltage, is applied from a power source S1 to the charging roller 2 across the core metal bar 2*a*, thereby charging the peripheral surface of the rotating photosensitive drum 1 to a predetermined potential.

c) Residual Charge Eliminating Means

Reference numeral 3 represents a residual charge eliminating means for uniformly eliminating residual charges from the charged surface of the photosensitive drum 1. According this embodiment, the residual charge eliminating means is a laser scanner. Further, this residual charge eliminating means serves also as an exposure means for forming an electrostatic latent image in this embodiment. Thus, the contrivance of making the residual charge eliminating means serve as another member enables also serves to decrease the number of parts.

When forming an image, the uniformly-charged surface of the rotating photosensitive drum 1 undergoes a laser scan exposure L (image exposure) in an exposure position "b" by outputting laser beams modulated corresponding to image signals transmitted to a printer side from a host device such as an unillustrated image reader, etc. With this laser scan exposure L, there decreases a potential of the portion, irradiated with the laser beams, of the surface of the photosensitive drum 1, and hence electrostatic latent images corresponding to pieces of image information with the scan exposure effected are sequentially formed on the surface of the rotating photosensitive drum 1.

d) Developing Means

Reference numeral 4 stands for a developing device defined as a developing means for making the electrostatic latent image visible by supplying a developer (toner) to the electrostatic latent image on the photosensitive drum 1. According to this embodiment, the developing means is a reversal developing device in a two-component magnetic brush developing system.

Reference symbol 4*a* denotes a developing container, and 4*b* represents a non-magnetic developing sleeve. This developing sleeve 4*b* is disposed rotatably within the developing container 4*a* in a way that exposing a part of the outer peripheral surface of this sleeve 4*b* to the outside. Reference symbol 4*c* designates a magnet roller so fixed as to be non-rotatable and inserted into the developing sleeve 4*b*, 4*d* is a developer coating blade, 4*e* is a two-component developer contained in the developing container 4*a*, 4*f* is a developer agitating member disposed on a bottom side within the developing container 4*a*, and 4*g* is a toner hopper containing the toner for replenishment.

The two-component developer 4*e* in the developing container 4*a* is a mixture of the toner and a magnetic carrier and is agitated by the developer agitating member 4*f*. In this embodiment, a resistance of the magnetic carrier is on the order of $10^{13}$ Ωcm, and a particle size thereof is on the order of 40 μm. The toner is frictionally charged to the negative polarity by a friction with the magnetic carrier (negative toner).

The developing sleeve 4*b* is disposed opposite to and in close proximity to the photosensitive drum 1 in a way that keeps a closest distance (which is referred to as S-D gap) of 350 μm between the sleeve 4*b* and the photosensitive drum 1. A portion in the developing sleeve 4*a*, which faces the photosensitive drum 1, is a developing portion "c". The developing sleeve 4*b* is rotationally driven at the developing portion "c" in a direction reversed to an advancing (rotating) direction of the photosensitive drum 1. A part of the two-component developer 4*e* in the developing container 4*a* is adsorptively held as a magnetic brush layer onto the outer peripheral surface of this developing sleeve 4*b* by a magnetic force of the magnet roller 4*c* in the developing sleeve, rotationally carried as the developing sleeve rotates, then tiered neatly as a predetermined thin layer by the developer coating blade 4*d*, subsequently brought into contact with the surface of the photosensitive drum 1 at the developing portion "c", and properly causes a friction with the surface of the photosensitive drum 1. A predetermined developing bias is applied to the developing sleeve 4*b* from a power source S2.

Thus, the developer is coated as the thin layer over the surface of the rotating developing sleeve 4*b*, and the toner component in the developer carried to the developing portion "c" is adhered selectively corresponding to the electrostatic latent image onto the surface of the photosensitive drum 1 by an electric field generated by the developing bias, whereby the electrostatic latent image is developed as a toner image. According to this embodiment, the toner is adhered onto an exposure bright portion of the surface pf the photosensitive drum 1, and the electrostatic latent image is reversely developed.

The thin layer of developer on the developing sleeve 4*b*, which has passed the developing portion "c", is carried back to a developer reservoir portion in the developing container 4*a* as the developing sleeve subsequently rotates.

In order to keep, within a predetermined and substantially fixed range, a toner density of the two-component developer 4*e* in the developing container 4*a*, for example, an unillustrated optical toner density sensor detects the toner density of the two-component developer 4*e* in the developing container 4*a*. The toner hopper 4*g* is drive-controlled based on this piece of detection information, thereby replenishing the two-component developer 4*e* in the developing container 4*a* with the toner in the toner hopper 4*g*. The toner replenished to the two-component developer 4*e* is agitated by the agitating member 4*f*.

e) Transferring Means/Fixing Means

Reference numeral 5 represents a transferring device that is a transferring roller in this embodiment. This transferring roller 5 is kept in press-contact with the photosensitive drum 1 by a predetermined pressing force, and its press-contact nip portion is a transferring part "d". A recording material (transferring material) P is fed at a predetermined control timing to this transferring part "d" from an unillustrated sheet feed mechanism portion.

The transferring material P fed to the transferring part "d" is held by binding between the rotating photosensitive drum 1 and the rotating transferring roller 5 (nipped) and thus conveyed. In the meantime, a transferring bias exhibiting a positive polarity opposite to the negative polarity as the normal charging polarity of the toner, is applied to the transferring roller 5 from a power source S3, whereby the toner images on the surface of the photosensitive rum 1 are sequentially electrostatically transferred onto the surface of the transferring material P that is nip-conveyed through the transferring part "d".

The recording material P, onto which the toner images have been transferred as it passed through the transferring part "d", is gradually separated from the surface of the rotating photosensitive drum 1 and conveyed to a fixing device 6 (e.g., a thermal roller fixing device), wherein the toner images on the recording material P are fixed. Then, the recording material P is outputted as an image-formed material (a print, a copy)

f) Cleanerless (Transfer Residual Toner Cleaning Simultaneous with Developing)

The printer in this embodiment is of a cleanerless system and is therefore not provided with a cleaning apparatus dedicated to removing a slight quantity of transfer residual toner staying on the surface of the photosensitive drum 1 after the toner images have been transferred onto the recording material P. The cleanerless (cleaning simultaneous with developing) system may be categorized as a method of collecting, into the developing apparatus, the transfer residual toner on the photosensitive member after being transferred, i.e., the transfer residual toner existing partially on the surface of the photosensitive member on which the toner should not be developed by a fog taking bias (which is a fog taking potential difference Vback defined as a potential difference between a DC voltage applied to the developing apparatus and a surface potential of the photosensitive member) during a developing process as a next process onward, i.e., during a course of electrostatic latent image developing process of subsequently charging the photosensitive member and forming the electrostatic latent image by an exposure. With the cleanerless system adopted, the transfer residual toner is collected into the developing apparatus and supplied for developing the electrostatic latent image in the next process onward, thereby making it possible to eliminate the waste toner and to reduce time-consuming maintenance work.

As discussed above, the closest distance (S-D gap) between the developing sleeve 4*b* of the developing device 4 and the photosensitive drum 1 is 350 $\mu$m, and, with this distance kept, the magnetic brush formed on the developing sleeve 4*b* causes the proper friction with the surface of the photosensitive drum, thereby collecting the residual toner simultaneously with developing. Moreover, the developing sleeve 4*b* is rotated in the direction reversal to the advancing (rotating) direction of the photosensitive drum 1 so as to have a merit in terms of collecting by the developing device.

The transfer residual toner on the surface of the photosensitive drum 1 is conveyed via the exposing portion "b", and therefore the exposing process is executed from on this transfer residual toner, however, a great influence does not occur because of the quantity of the transfer residual toner being small.

The transfer residual toner on the surface of the photosensitive drum 1 after the transferring process, however, contains the negative polarity toner in the imaging portion, the positive polarity toner in the non-imaging portion and the toner of which the polarity is reversed to the positive polarity as it has been influenced by the positive polarity voltage for transferring.

Among those categories of toners, the polarity-reversed toner and the toner with the small amount of charging are adhered to the charging roller 2 upon passing through the charging portion "a", and therefore the charging roller is more contaminated with the toner than at an allowable level, with the result that a charging failure occurs.

Further, it is required for making the developing device 4 effectively clean, simultaneously with developing, the transfer residual toner on the surface of the photosensitive drum 1 that the charging polarity of the transfer residual toner on the photosensitive drum 1 that is to be conveyed to the developing portion "c" be the normal polarity and that the charging quantity thereof be a toner charging quantity large enough for the developing apparatus to develop the electrostatic latent image on the photosensitive drum. The polarity-reversed toner and the toner with the charging quantity improper can be neither removed nor collected by the developing apparatus from on the photosensitive drum, and it follows that this causes a defect in the image.

To obviate such a problem, there is a method of providing a charging developer charging quantity control means, disposed more downstream in the rotating direction of the photosensitive member than the transferring means, for controlling the residual developer residual on the photosensitive member.

According to this embodiment, a toner charging quantity control means 7 is provided between the transferring part "d" and the charging portion "a" in order to uniformize the polarity of the transfer residual toner to the negative polarity as the normal polarity. In this embodiment, the toner charging quantity control means 7 is a conductive brush exhibiting a proper conductivity, and a voltage of the negative polarity is applied thereto from a power source S4. The transfer residual toner passing through the conductive brush 7 is uniformized to the negative polarity. Since the polarity of the transfer residual toner is uniformized to the negative polarity, it does not happen that the toner is adhered to the charging roller 2. In the developing process, the transfer residual toner on the photosensitive drum 1 on which the toner should not be developed, is collected by the developing device 4 in terms of the electric field.

This embodiment involves providing a single developer charging quantity control means, however, there is a method of providing two pieces of developer charging quantity control means such as a first developer charging quantity control means and a second developer charging quantity control means, disposed more downstream than the first developer charging quantity control means and more upstream than the contact charging means, for charging the residual developer remaining on the photosensitive member. The residual developer remaining on the photosensitive member after the transferring of the developer undergoes the charging process with the polarity opposite to the normal polarity by use of the first developer charging quantity control means, then the thus charging-processed residual developer on the photosensitive member is subjected to the charging process to the normal polarity by use of the second developer charging quantity control means, subsequently the contact charging means charges the surface of the photosensitive member, and at the same time, a proper charging quantity is obtained. As described above, after the executing the charging process once to the reversed polarity, the residual developer undergoes the charging process to the normal polarity, whereby the developer can be more surely uniformized to the normal polarity with the proper charging quantity.

Thus, the uniformization of the polarity of the developer to the normal polarity prevents the transferring residual developer from being adhered to the contact charging means and enables the developing means to efficiently collect the transferring residual developer, and it is possible to provide the image forming apparatus that makes the most use of the merit of the cleanerless system with neither the charging failure nor the defect in the image.

A control means 100 for controlling the charging voltage is a control circuit portion that controls a sequence of the whole of the image forming apparatus.

(2) Charging Control

Given next is a description of a method (discharging current quantity control) of controlling a peak-to-peak voltage of an AC voltage that is applied to the charging roller 2 during a printing period (image forming period).

Figure 3:
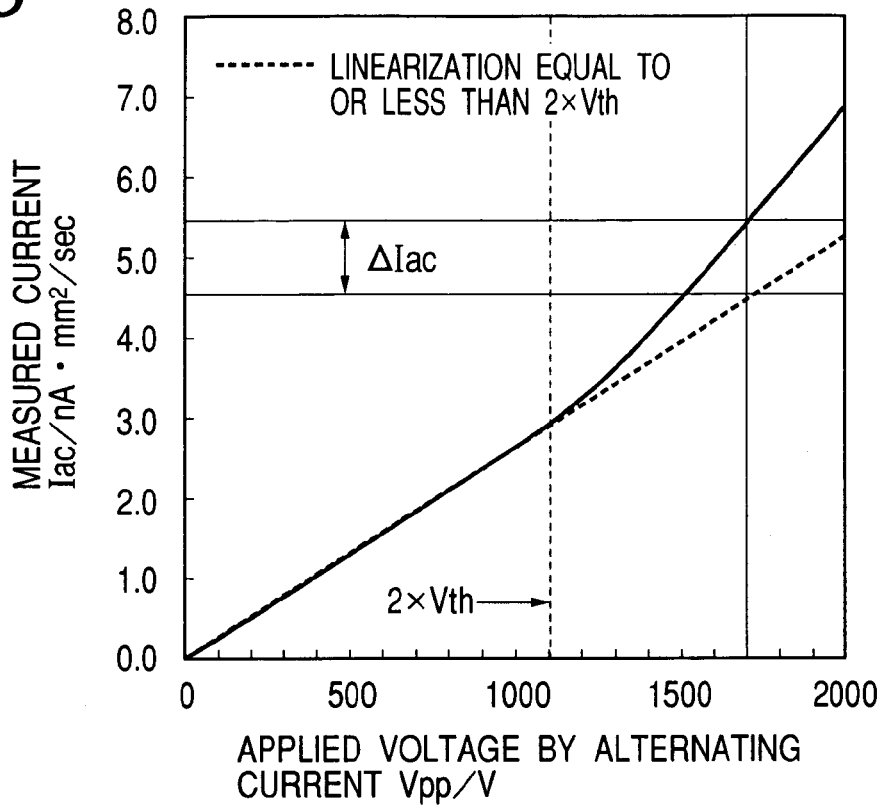
FIG. 3 is an explanatory graph of a discharge current quantity.

As shown in FIG. 3, an AC current Iac has a linear relationship with a peak-to-peak voltage Vpp on condition of being less than a discharge start voltage Vth×2(V) (undischarged area), in which the AC current Iac gradually diverts in a current-increasing direction as it becomes equal to or greater than the discharge start voltage Vth×2(V) (discharged area) with respect to the peak-to-peak voltage Vpp. The linearity was kept in the same test in vacuum where no discharge occurs, and hence this is assumed to be an increment ΔIac of the current contributing to the discharge.

Note that the discharge start voltage Vth is an applied DC voltage value with which the photosensitive member start being charged when continuing to increase the DC voltage applied to the charging roller defined as the charging member.

Hence, let a be a ratio of the current Iac to the peak-to-peak voltage Vpp that is less than the discharge start voltage Vth×2(V), and an AC current such as a nip current other than the discharge-related current becomes α·Vpp. Then, a difference between this AC current α·Vpp and the AC current Iac measured when applying a voltage that is equal to or larger than the discharge start voltage Vth×2(V), is given by:

$$\Delta Iac = Iac - \alpha \cdot Vpp \quad (1)$$

where ΔIac is defined as a discharge current quantity substitutionally representing a discharge quantity.

The peak-to-peak voltage of the AC voltage is controlled during the image forming period so that this discharge current quantity becomes fixed, whereby invariably a fixed quantity of discharge is generated without causing any excessive discharge irrespective of fluctuation, etc. in the resistance value of the charging member that is to be attributed to its environment and how it is manufactured. The uniform charge can be thus performed without causing any problems such as a deterioration of the image bearing member, an adhesion of the toner, and an image flow. Namely, the uniform charge can be made even in the case of such discharging/charging as to apply the peak-to-peak voltage that is twice or larger than Vth.

In the case of performing the charge under the control at the fixed voltage or the fixed current, this discharge current quantity changes depending on the environment and on how much the durability is progressed. This is because there is a fluctuation in a relationship between the peak-to-peak voltage and the discharge current quantity and a relationship between the AC current value and the discharge current quantity.

Now, assuming that D be a desired discharge current quantity, a method of determining such a peak-to-peak voltage as to obtain this discharge current quantity D, will be explained.

Figure 4:
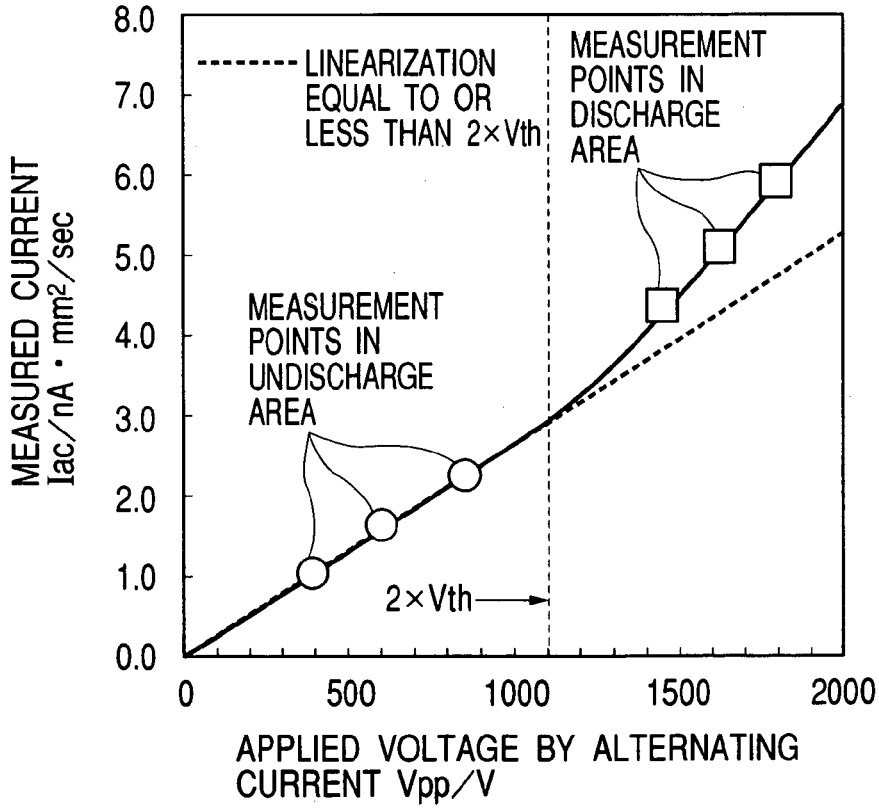
FIG. 4 is an explanatory graph showing a procedure of determining a peak-to-peak voltage Vpp serving as a discharge current quantity D.

The control circuit portion 100 of the image forming apparatus applies, as shown in FIG. 4, during a print preparatory rotation period, the peak-to-peak voltage (Vpp) at three points in the discharge area to the charging roller 2 and applies the peak-to-peak voltage at three points in the undischarged area to the charging roller 2 in sequence, and measures AC current values at this time.

Next, the control circuit portion 100 performs, based on the current values measured at each set of three points, linear approximations in the discharge area and in the undischarged area by use of the least-squares method, and calculates as in the following formula 2 and formula 3:

Approximate straight line in discharge area:

$$Y_\alpha = \alpha X_\alpha + A \quad (2)$$

Approximate straight line in undischarged area:

$$Y_\beta = \beta X_\beta + B \quad (3)$$

Thereafter, a peak-to-peak voltage Vpp that makes a difference between the approximate straight line $Y_\alpha$ in the discharge area and the approximate straight line $Y_\beta$ in the undischarged area become the discharge current quantity D, is determined in the following formula 4:

$$Vpp = (D - A + B)/(\alpha - \beta) \quad (4)$$

Then, the peak-to-peak voltage applied to the charging roller 2 is changed over to the thus obtained peak-to-peak voltage Vpp, and the processing shifts to the image forming operation described above.

In this way, during the print preparatory rotation period, the peak-to-peak voltage required for obtaining the predetermined discharge current quantity for printing, is calculated each time, and, when printing, the obtained peak-to-peak voltage is applied, whereby a desired discharge current quantity can be surely acquired in a way that absorbs a deflection of the resistance value and a high-voltage fluctuation in the main body which are derived from ununiformity in manufacturing the charging roller 2 and an environmental fluctuation in the material. Further, this process is called discharge current quantity control. It may suffice for executing the aforementioned current measurement that the peak-to-peak voltage (Vpp) at least two points in the discharge area may be applied to the charging roller 2, and the peak-to-peak voltage at least one point in the undischarged area is applied to the charging roller 2.

Herein, an emphasis is put on a potential over the peripheral surface of the photosensitive drum 1 under the discharge current quantity control described above. An oscillating voltage obtained by superposing an AC voltage having a frequency "f" on a DC voltage is applied to the charging roller 2, and if this AC voltage is the peak-to-peak voltage (Vpp) in the discharge area, the potential over the photosensitive drum takes a value of the DC voltage (Japanese Patent Application Laid-Open No. 3-52058).

However, it follows that the photosensitive drum potential in a case where this AC voltage is the peak-to-peak voltage in the undischarged area, is generated as it is conditioned by the potential influenced on the photosensitive drum by the transferring/toner charging quantity control means disposed more upstream than the charging roller 2 and by the potential that has been generated when the previous printing operation is finished. Namely, the transferring/toner charging quantity control means operates in the same way as usual in advance of measuring the charging current in the undischarged area.

Figure 5:
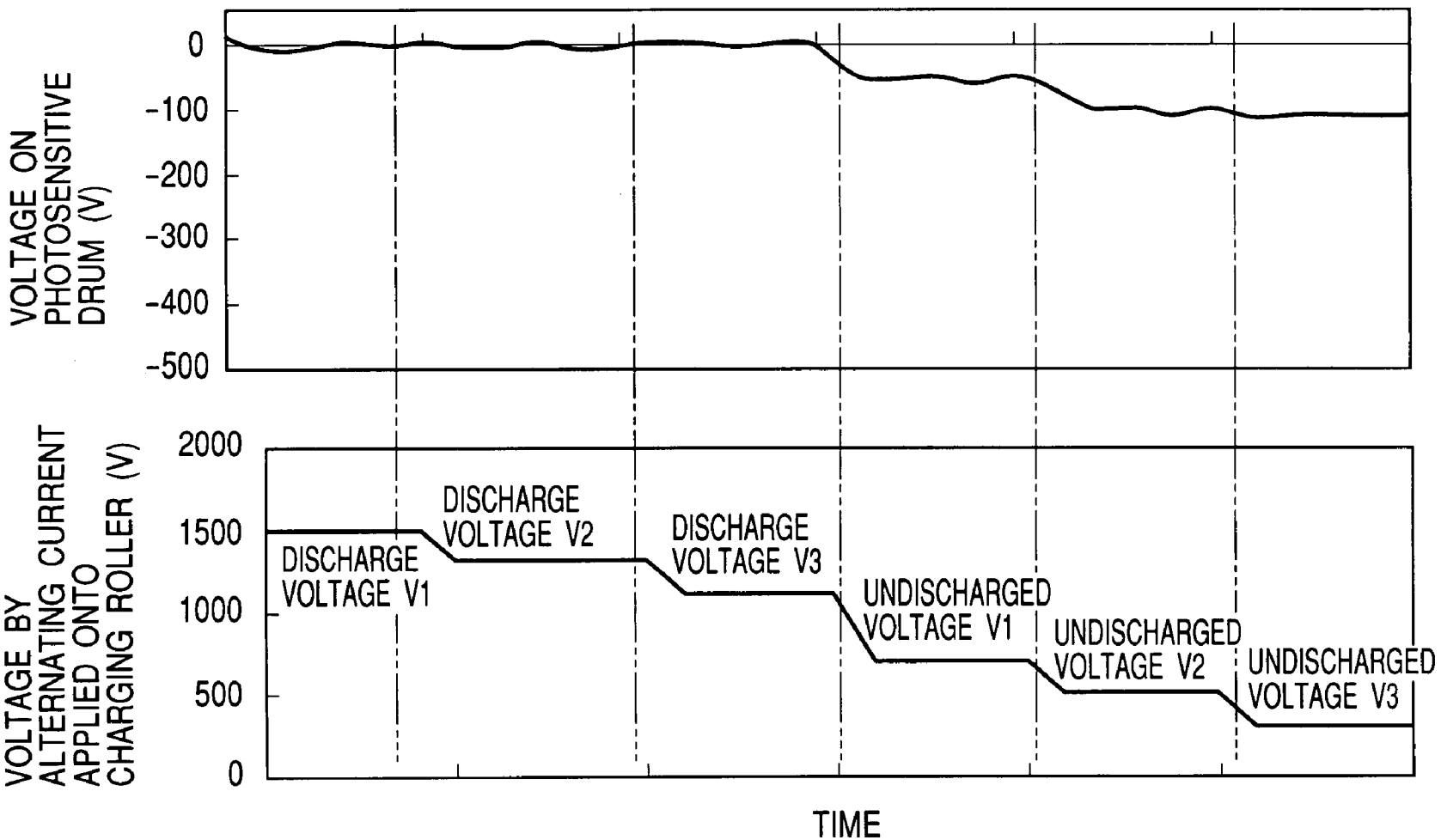
FIG. 5 is a graphic chart showing a relationship between a potential on the photosensitive drum (upper graph) after a passage of the charging roller under discharge current quantity control and an AC current (lower graph) applied to the charging roller.

FIG. 5 shows a relationship between the photosensitive drum potential (upper graph) after passing through the charging roller 2 under the discharge current quantity control and the AC voltage (lower graph) applied to the charging roller 2. The DC voltage applied to the charging roller 2 at this time is set at 0(V). Discharge voltages V1, V2 and V3 shown in FIG. 5 indicate 3-point applications of such a peak-to-peak voltage (Vpp) that the AC voltage is in the discharge area, and it can be understood that the photosensitive drum potential at this time is approximately 0(V).

Under the discharge current quantity control, the rotation of the developing sleeve 4*b* of the developing device 4 remains stopped, and a voltage supply to the developing sleeve 4*b* is also suspended, in which both of the AC and DC components are 0(V). While the discharge voltage is applied to the charging roller 2, as described above, there is no potential difference between the photosensitive drum 1 and the developing sleeve 4*b*, and hence the two-component developer existing in the S-D gap between the developing sleeve 4*b* and the photosensitive drum 1 can hold the state retained on the developing sleeve 4*b*. Namely, the developer does not migrate onto the photosensitive drum 1 from the developing sleeve 4*b*. In this embodiment, it is not required that the voltage is applied to the developing sleeve 4*b*, and hence there is no necessity of creating an ON/OFF sequence of the voltage applied to the developing the sleeve under the discharge current quantity control.

In this embodiment, the voltage supplied to the developing sleeve is set at 0V, however, the developing sleeve may be supplied with such a voltage set at, e.g., +200V that the toner does not migrate to the photosensitive drum 1 from the developing sleeve 4*b*. Herein, the voltage at which the toner does not migrate to the photosensitive drum 1 from the developing sleeve 4*b*, is determined based on the potential difference between the photosensitive drum 1 and the developing sleeve 4*b*. Further, the voltage applied to the developing sleeve is kept to 0V, while the DC voltage applied to the charging roller may be set at −200V. At this time, the photosensitive member is charged to −200V by the charging roller, and it is therefore possible to prevent the toner from migrating to the photosensitive drum 1 from the developing sleeve 4*b*.

In the case of the reversal developing, the voltage may be applied to the developing sleeve 4*b* so that the potential on the photosensitive drum 1 becomes higher on the side of the normal polarity of the developer than the potential on the developing sleeve 4*b*. For example, if the photosensitive drum 1 is charged to −200V, any one of voltages such as −200V, −100V, 0V, +100V, +200V, and +300 may be applied to the developing sleeve 4*b*. In this case, if the voltage applied to the developing sleeve is a plus voltage, the voltage may take whatever absolute value. An attention is, however, needed in the case of the two-component developer including the toner and the magnetic carrier. Generally, the magnetic carrier assumes the charging polarity opposite to the polarity of the toner. Hence, if the potential difference between the photosensitive drum 1 and the developing sleeve 4*b* is too large, the toner adhesion does not occur, however, it happens that the magnetic carrier is attracted by a force based on the electric field rather than the magnetic restriction force of the magnet, etc. and is adhered to the photosensitive drum 1.

In the case of the normal developing, the voltage may be applied to the developing sleeve 4*b* so that the potential on the photosensitive drum 1 gets higher on the side of the normal polarity of the developer than the potential on the developing sleeve 4*b*. For example, if the photosensitive drum 1 is charged to −200V, a voltage such as −200V, −300V, −400V may be applied to the developing sleeve 4*b*. In the case of the two-component developer including the toner and the magnetic carrier, however, as in the case of the reversal developing, the voltage applied to the developing sleeve 4*b* must be determined so that the adhesion of the magnetic carrier does not occur and that the potential difference between the photosensitive drum 1 and the developing sleeve 4*b* does not become too large.

Hence, the voltage at which the toner does not migrate to the photosensitive drum 1 from the developing sleeve 4*b* is preferably a voltage that causes no adhesion of the magnetic carrier as well as being a voltage that causes no adhesion of the toner.

As in this embodiment, if the DC voltage is set at 0V when the AC voltage including the peak-to-peak voltage in the discharge area is applied to the charging roller under the discharge current quantity control, the drum potential on the photosensitive drum 1 comes to approximately 0V. Therefore, whether the normal developing or the reversal developing, when this area shifts to the developing portion, it follows that the voltage applied to the developing device 4 may be 0V. Namely, if the photosensitive drum is set charging at 0V, it is not required that the voltage is applied to the developing sleeve 4*b*, and hence there is not necessity of creating the ON/OFF sequence of the voltage applied to the developing sleeve.

Next, in the case where the AC voltage is the peak-to-peak voltage (undischarged voltages V1, V2, V3 in FIG. 5) in the undischarged area, the photosensitive drum potential after passing through the charging roller has become unstable. The photosensitive drum potential when applying the peak-to-peak voltage in the undischarged area depends on the photosensitive drum potential generated more upstream than the charging roller 2, and this value changes based on the environment, a consumed state of the photosensitive member, etc. and is therefore hard to predict.

Particularly, as in this embodiment, in the image forming apparatus provided with the toner charging quantity control means 7, the photosensitive drum potential is generated by the toner charging quantity control means 7, and therefore it is considered that ununiformity of the potential in a hyperfine area might occur. In the case of applying the peak-to-peak voltage in the discharge area, even if there exists the ununiformity of the potential in the hyperfine area, no problem arises because of uniformly undergoing the charging process. When the photosensitive drum potential as it remains in the state of the peak-to-peak voltage in the undischarged area being applied comes to the developing portion "c", the toner and the carrier are adhered to the photosensitive drum 1, with the result that the defect in the image occurs due to the contamination of the transferring part "d" and so forth.

Figure 6:
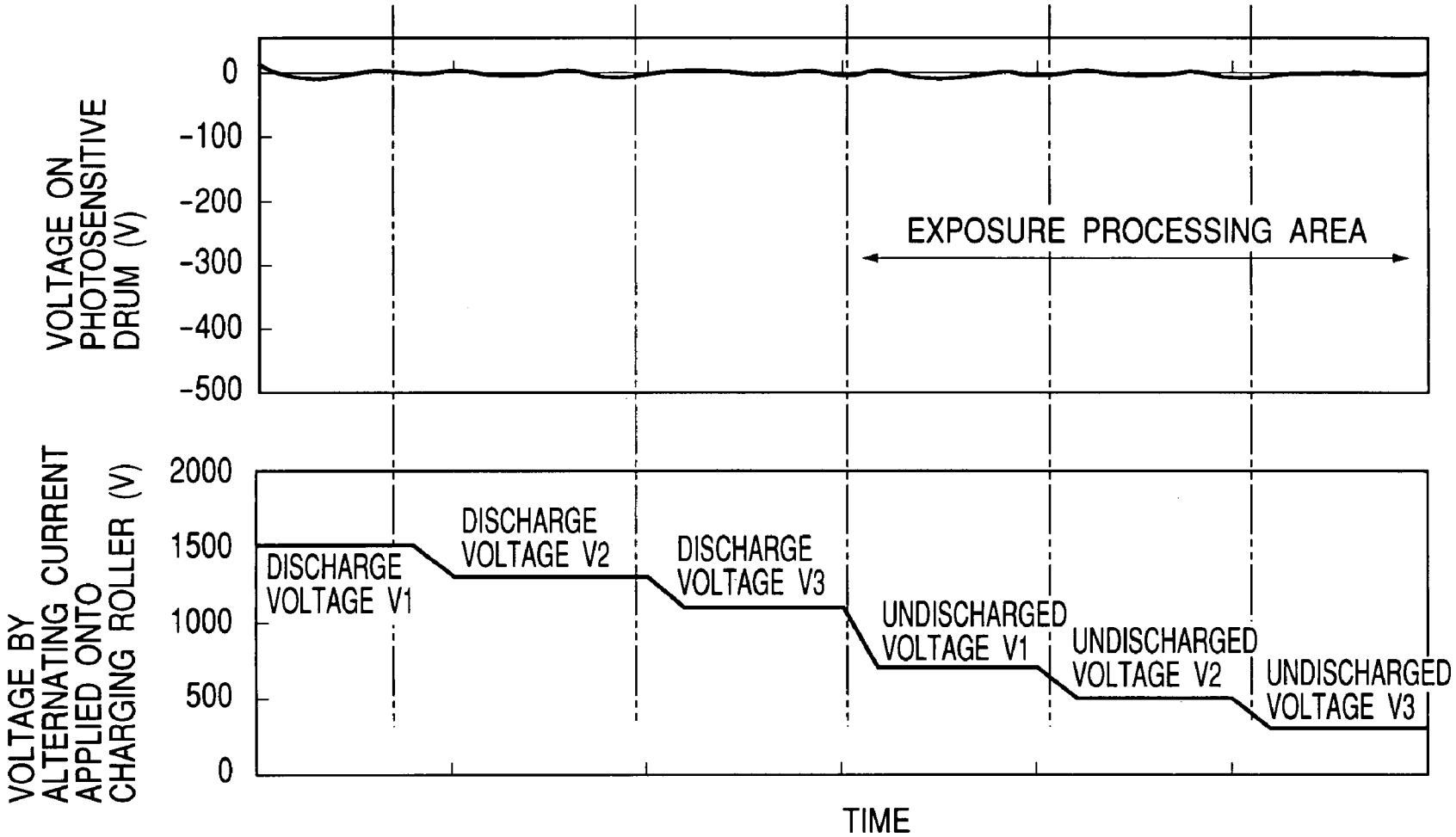
FIG. 6 is a graphic chart showing a relationship between a potential on the photosensitive drum (upper graph) after the passage of the charging roller under the discharge current quantity control and an AC current (lower graph) applied to the charging roller in the case of executing an exposure process at a timing when applying such a peak-to-peak voltage that the AC voltage is in an undischarged area.

In view of the problem described above, according to this embodiment, the exposure process is executed by the laser scanner at a timing of applying such a peak-to-peak voltage in which the AC voltage is in the undischarged area. This exposure process is that the entire surface of the photosensitive member is exposed to the light as in the case of forming the image on the whole surface of the image formable area. FIG. 6 shows a relationship between the potential (upper graph) on the photosensitive drum after passing through the charging roller under the discharge current quantity control and the AC voltage (lower graph) applied to the charging roller.

In the case of such a peak-to-peak voltage (undischarged voltages V1, V2, V3 in FIG. 6) in which the AC voltage is in the undischarged area, the photosensitive drum potential is approximately 0(V).

Under the discharge current quantity control, the rotation of the developing sleeve 4*b* remains stopped, and a voltage supply to the developing sleeve 4*b* is also suspended, in which both of the AC and DC components are 0(V). While the peak-to-peak voltage in the undischarged area is applied, as described above, there is no potential difference between the photosensitive drum 1 and the developing sleeve 4*b*, and therefore the two-component developer existing in the S-D gap between the developing sleeve 4*b* and the photosensitive drum 1 can hold the state retained on the developing sleeve 4*b*. Namely, the developer does not migrate to the photosensitive drum 1 from the developing sleeve 4*b*.

As discussed above, in the case of setting, at Vth, a discharge start voltage to the photosensitive drum when applying the DC voltage to the charging roller, the exposure means performs an exposure over the photosensitive drum surface to which the AV voltage as the peak-to-peak voltage that is twice or less than Vth in charging is applied, thereby stabilizing the photosensitive drum potential at zero and causing no potential difference between the photosensitive drum and the developing sleeve by executing the exposure process even in the case of such a peak-to-peak voltage in which the AC voltage applied to the charging roller 2 is in the undischarged area. Therefore, the two-component developer existing in the S-D gap between the developing sleeve and the photosensitive drum can hold the state retained on the developing sleeve, whereby the occurrence of the defect in the image can be restrained.

Moreover, the potentials both in the undischarged area and in the discharge area for measuring the charging currents on the photosensitive member, can be set at 0V, and hence the potential (0V) applied to the developing sleeve may not be changed over for the two areas.

<Others>

1) The charging means for the image bearing member does not necessarily abut on the surface of the image bearing member. The charging means and the image bearing member may also be disposed in a non-contact manner in close proximity to each other with an air gap (gap) that is, e.g., several tens of $\mu$m on condition that just a dischargeable area determined by a gap-to-gap voltage and a compensation Paschen's curve be certainly assured (proximal charging).

2) The toner charging quantity control means 7 is the fixed brush-shaped member in the embodiment and may also be a member taking an arbitrary form such as a brush rotary member, an elastic roller member, a sheet-like member and so forth.

3) The image bearing member has also the same effects in such a case that the charging transporting layer is within a resistance rage of $10^9$ through $10^{14}$ $\Omega$·cm. An amorphous silicon photosensitive member of which a surface layer volume resistance is on the order of $10^{13}$ $\Omega$·cm is also available.

4) The contact charging member exhibiting the flexibility can involve using, in addition to the charging roller, configurations and materials such as fur brushes, felts, clothes and so forth. Further, it is possible to acquire the members exhibiting a more proper elasticity, conductivity, surface property and durability by combining a variety of materials.

5) A sine wave, a rectangular wave, a triangular wave, etc. can be properly used as a waveform of the alternating voltage component (an AC component, a voltage with its voltage value that periodically changes) of the oscillating electric field which is applied to the charging means and the developing means. A rectangular wave formed by periodically switching ON/OFF the DC power source may also be used.

6) The exposure means for exposing the charging surface of the photosensitive member as the image bearing member may also be, other than the laser scan means in the embodiment, a digital exposure means utilizing a sold-state light emitting element array such as LEDs. An analogous image exposure means including a light source for illuminating an original such as a halogen lamp or a fluorescent lamp may also be utilized. In short, there can be used whatever exposure means capable of forming the electrostatic latent image corresponding to the image information.

7) The toner developing system and the toner developing means for the electrostatic image are arbitrary. Either the reversal developing system or the normal developing system is available.

Generally, the method of developing the electrostatic latent image is roughly classified into the following four methods. A first method is a method (single-component non-contact developing) of developing the electrostatic latent image by coating a non-magnetic toner over the developer carrying member such as the sleeve with a blade, etc., also coating a magnetic toner over the developer carrying member and carrying this by the magnetic force, and applying those toners to the image bearing member in a non-contact state. A second method is a method (single-component contact developing) of developing the electrostatic latent image by applying the toners coated over the developer carrying member as described above to the image bearing member in a contact state. A third method is a method (two-component contact developing) of developing the electrostatic latent image by using what mixes the toner particles with the magnetic carrier as a developer (two-component developer), then carrying the developer by the magnetic force, and applying the developer to the image bearing member in the contact state. A fourth method is a method (two-component non-contact developing) of developing the electrostatic latent image by applying the aforementioned two-component developer to the image bearing member in the non-contact state. The present invention can be applied to every developing method given above.

8) The transferring means is not limited to the roller transferring means exemplified in the embodiment and may include a blade transferring means, a belt transferring means, other type of contact transfer charging system and also a non-contact transfer charging system utilizing a corona charger.

9) The present invention can be applied to an image forming apparatus for forming not only a monochromatic image but also a multi-color/full-color image by multiple transferring, etc., which involves using an intermediate transferring member such as a transferring drum, a transferring belt and so forth.

10) This embodiment has exemplified the image forming apparatus in the cleanerless system for collecting the developer with the developing means, however, the developer may also be collected from the image bearing member by the transferring means.

11) According to this embodiment, the residual charge eliminating means serves as the electrostatic latent image forming means and may also separately be provided. The residual charge eliminating means may not, as for its position, be disposed downstream of the charging means and upstream of the developing means in the moving direction of the image bearing member, and the residual charge may also be eliminated by the exposure member described above upstream of the charging means in the moving direction of the image bearing member.

As discussed above, according to the present invention, the image forming apparatus including the means for controlling the voltage value of the peak-to-peak voltage of the AC voltage which is applied to the charging means for charging the image bearing member, is capable of restraining the occurrence of the defect in the image, which is derived from the instability of the charging potential on the image bearing member by stabilizing the potential on the image bearing member even in the case of such a peak-to-peak voltage in which the AC voltage applied to the charging means for the image bearing member is in the undischarged area.

What is claimed is:

1. An image forming apparatus comprising:

an image bearing member;

charging means, to which a voltage including an AC voltage is applied, for charging the image bearing member;

control means for controlling a peak-to-peak voltage of the AC voltage;

developing means for developing an electrostatic latent image formed on the image bearing member with a developer; and residual charge eliminating means for conducting charge elimination on the image bearing member, wherein the control means controls the peak-to-peak voltage of the AC voltage which is applied to the charging means during an image forming period, on the basis of both an AC current flowing when applying the AC voltage having a voltage level of the peak-to-peak voltage that is less than twice the discharge start voltage Vth of the image bearing member to the charging means during a non-image forming period and another AC current flowing when applying the AC voltage having a voltage level of the peak-to-peak voltage that is equal to or more than twice the discharge start voltage Vth of the image bearing member to the charging means during a non-image forming period, and wherein the residual charge eliminating means conducts charge elimination on an area on the image bearing member that passes through a charging position of the charging means when applying the AC voltage having a voltage level of the peak-to-peak voltage that is less than twice the discharge start voltage Vth of the image bearing member to the charging means.

2. An image forming apparatus according to claim 1, wherein when applying the AC voltage including the peak-to-peak voltage that is equal to or more than twice the discharge start voltage Vth to the charging means during the non-image forming period, a voltage level of a DC voltage applied to the charging means is OV.

3. An image forming apparatus according to claim 1, wherein while the area on the image bearing member is in a developing position of the developing means, a voltage of such a level that a toner of the developer is not adhered to the image bearing member from the developing means, is applied to the developing means.

4. An image forming apparatus according to claim 1, wherein while the area on the image bearing member is in a developing position of the developing means, a voltage applied to the developing means is OV.

5. An image forming apparatus according to claim 2, wherein while the area on the image bearing member and an area on the image bearing member that is charged by the charging means when the AC voltage having a voltage level of the peak-to-peak voltage that is equal to or more than twice the discharge start voltage Vth of the image bearing member is applied to the charging means during the non-image forming period, are in a developing position of the developing means, a voltage applied to the developing means is fixed.

6. An image forming apparatus according to claim 2, wherein while the area on the image bearing member and an area on the image bearing member that is charged by the charging means when the AC voltage having a voltage level of the peak-to-peak voltage that is equal to or more than twice the discharge start voltage Vth of the image bearing member is applied to the charging means during the non-image forming period, are in a developing position of the developing means, a voltage applied to the developing means is OV.

7. An image forming apparatus according to claim 1, wherein the peak-to-peak voltage of the AC voltage which is applied to the charging means during the image forming period is equal to or more than twice the discharge start voltage Vth.

8. An image forming apparatus according to claim 1, wherein the non-image forming period is a preparatory rotation period of the image bearing member before executing an image formation.

9. An image forming apparatus according to claim 1, wherein the residual charge eliminating means is electrostatic latent image forming means for forming an electrostatic latent image on a surface of the image bearing member that is charged by the charging means.

10. An image forming apparatus according to claim 9, wherein the image bearing member is a photosensitive member, and wherein the residual charge eliminating means is exposure means for conducting exposure on the image bearing member in order to form the electrostatic latent image on the surface of the image bearing member that is charged by the charging means.

11. An image forming apparatus according to claim 1, wherein the residual charge eliminating means conducts charge elimination on the image bearing member on a downstream side of the charging means and an upstream side of the developing means with respect to a moving direction of the image bearing member.

12. An image forming apparatus according to claim 1, wherein the developing means also serves as cleaning means for collecting the developer remaining on a surface of the image bearing member.

13. An image forming apparatus according to claim 1, further comprising transferring means for transferring, onto a material to be transferred, an image that is formed on the image bearing member with the developer.

14. An image forming apparatus according to claim 13, wherein the transferring means also serves as cleaning means for collecting the developer remaining on a surface of the image bearing member.

15. An image forming apparatus according to claim 1, further comprising developer charging quantity control means, disposed further upstream than the charging means and further downstream than the transferring means with respect to the moving direction of the image bearing member, for applying a DC voltage in order to charge a residual developer remaining on the image bearing member to a normal polarity of the developer.

16. An image forming apparatus according to claim 1, wherein the charging means is brought into contact with the image bearing member to charge the image bearing member.

17. An image forming apparatus according to claim 1, wherein the charging means conducts charging by causing discharge between the charging means and the image bearing member.

18. An image forming apparatus according to claim 1, wherein the developing means performs developing by bringing the developer on the developing means into contact with the image bearing member.

* * * * *

UNITED STATES PATENT AND TRADEMARK OFFICE

CERTIFICATE OF CORRECTION

PATENT NO. : 6,999,690 B2
APPLICATION NO. : 10/617024
DATED : February 14, 2006
INVENTOR(S) : Yasunari Watanabe et al.

It is certified that error appears in the above-identified patent and that said Letters Patent is hereby corrected as shown below:

COLUMN 4:

Line 42, "cylinder" should read --cylinder (conductive drum substrate) 1*a*.--;
Line 44, "(Conductive Drum Substrate) 1*a*." should be deleted.

COLUMN 5:

Line 1, "an" should read --a--;
Line 2, "roller," should read --roller, and the surface layer 2*d* is a protection layer provided for preventing a leak from ocurring even if a flaw such as a pinhole exists on the photosensitive drum 1. To be more specific, specifications of the charging roller--;
Line 10, "The" should read --¶The--; and
Line 15, "Surface" should read --¶Surface--.

COLUMN 7:

Line 15, "rum 1" should read --drum 1--;
Line 26, "copy)" should read --copy).--; and
Line 53, "work." should read --work. Further, this cleanerless system has a merit in terms of downsizing the image forming apparatus. According to this embodiment, the transfer residual toner on the surface of the photosensitive drum 1 after being the transferred, is conveyed to the developing portion "c" via the charging portion "a" and the exposing portion "b" as the photosensitive drum 1 subsequently rotates, and is cleaned (collected) simultaneously with developing by the developing device 4.--.

COLUMN 8:

Line 26, "charging" should read --improper charging--; and
Line 27, "improper" should be deleted.

COLUMN 9:

Line 37, "start" should read -starts--; and
Line 41, "let a" should read --let α--.

COLUMN 11:

Line 34, "developing the" should read --developing--; and
Line 57, "+300" should read --+300V--.

UNITED STATES PATENT AND TRADEMARK OFFICE

CERTIFICATE OF CORRECTION

PATENT NO. : 6,999,690 B2
APPLICATION NO. : 10/617024
DATED : February 14, 2006
INVENTOR(S) : Yasunari Watanabe et al.

It is certified that error appears in the above-identified patent and that said Letters Patent is hereby corrected as shown below:

COLUMN 14:

Line 15, "sold-state" should read --solid-state--.

COLUMN 16:

Line 4, "OV." should read --0V.--; and
Line 25, "OV." should read --0V.--.

Signed and Sealed this

Twenty-ninth Day of August, 2006

JON W. DUDAS
*Director of the United States Patent and Trademark Office*